US005381631A

United States Patent [19]

Raghavan et al.

[11] Patent Number: 5,381,631

[45] Date of Patent: Jan. 17, 1995

[54] METHOD AND APPARATUS FOR CUTTING METAL CASINGS WITH AN ULTRAHIGH-PRESSURE ABRASIVE FLUID JET

[75] Inventors: Chidambaram Raghavan, Kent; John Olsen, Vashon; Curtis L. Anderson, Puyallup, all of Wash.; Alton J. LaLande, Lafayette, La.

[73] Assignee: Flow International Corporation, Kent, Wash.

[21] Appl. No.: 48,659

[22] Filed: Apr. 15, 1993

[51] Int. Cl.[6] ..... B24C 3/00

[52] U.S. Cl. ..... 451/75; 166/298; 166/55.7; 451/89; 451/76; 451/36; 451/38

[58] Field of Search ..... 51/281 P, 317, 319, 51/320, 321, 410, 411, 428, 429, 439; 166/298, 223, 55.7, 55.1

[56] References Cited

U.S. PATENT DOCUMENTS

| | | | |
|---|---|---|---|
| 2,265,082 | 12/1941 | O'Neill | 51/8 |
| 2,315,496 | 4/1943 | Boynton | 166/1 |
| 3,066,735 | 12/1962 | Zingg | 166/55 |
| 3,081,828 | 3/1963 | Quick | 175/67 |
| 3,145,776 | 8/1964 | Pittman | 166/55 |
| 3,338,305 | 8/1967 | Pittman et al. | 166/35 |
| 3,393,736 | 7/1968 | Goodwin | 166/12 |
| 3,585,699 | 6/1971 | Shuttle | 29/407 |
| 4,047,569 | 9/1977 | Tagirov et al. | 166/308 |
| 4,346,761 | 8/1982 | Skinner et al. | 166/206 |
| 4,619,556 | 10/1986 | Parra | 405/195 |
| 4,648,215 | 3/1987 | Hashish et al. | 51/439 |
| 4,768,899 | 9/1988 | Dysarz | 405/195 |
| 5,001,870 | 3/1991 | Yokota et al. | 51/410 |
| 5,010,694 | 4/1991 | Agbede | 51/429 |
| 5,065,551 | 11/1991 | Fraser | 51/410 |
| 5,144,766 | 9/1992 | Hashish et al. | 51/439 |

*Primary Examiner*—Bruce M. Kisliuk
*Assistant Examiner*—Eileen P. Morgan
*Attorney, Agent, or Firm*—Seed and Berry

[57] ABSTRACT

A method and apparatus for cutting metal casings with an ultrahigh-pressure abrasive fluid jet is shown and described. Examples of such casings include piles and conductors of offshore oil production platforms. In accordance with a preferred embodiment of the present invention illustrated herein, the apparatus is lowered inside the casing to be cut to a desired depth where it is secured to an inner surface of the casing. An ultrahigh-pressure stream of fluid is forced through a nozzle provided in a jet manifold of the apparatus to produce an ultrahigh-pressure fluid jet, into which a volume of abrasives is entrained, thereby generating an abrasive fluid jet. A drive mechanism is provided to rotate the abrasive fluid jet in a substantially horizontal plane to produce a circumferential cut in the casing. The abrasive fluid jet may also be moved in a vertical plane if necessary to complete the cut, for example if the initial cut is in the form of a helix. The performance of the jet is monitored by listening to the sound intensity of the jet with hydrophones.

In accordance with the present invention, the cut in the casing may be made by the abrasive fluid jet in either a water or air environment, an air environment being created in a vicinity of the abrasive fluid jet by displacing a volume of water. The volume of abrasives may be entrained in the ultrahigh-pressure fluid jet by a vacuum created by the jet passing through the nozzle or, in an alternative embodiment, the abrasives may be entrained in a pressurized stream of a low density medium such that the pressurized abrasives are injected into the ultrahigh-pressure fluid jet.

23 Claims, 11 Drawing Sheets

METHOD AND APPARATUS FOR CUTTING METAL CASINGS WITH AN ULTRAHIGH-PRESSURE ABRASIVE FLUID JET

TECHNICAL FIELD

This invention relates to abrasive fluid jets, and more particularly, to a method and apparatus for cutting metal casings below the sea bed with an abrasive fluid jet.

BACKGROUND OF THE INVENTION

Offshore platforms used in the recovery of oil from below the sea bed must be removed and appropriately disposed of when the oil wells serviced by the platform run dry. The platforms are anchored to the ocean floor by piles which are hollow casings or pipes driven into the sea bed. The platforms draw oil up through conductors which are made of several hollow casings of different diameters stacked within each other and extending to various depths below the sea bed. The casings of a conductor are sealed together with concrete grout. The law requires that when removing an offshore platform, both the piles and conductors must be cut twenty feet below the mud line so that no projections are left which could pose a navigational hazard.

Current methods for removing offshore platforms include the use of explosives and the use of mechanical cutters driven from the surface. However, explosives are harmful to the surrounding ecosystem and mechanical cutting devices require a large amount of power and sufficient structure to support heavy machinery. A need therefore exists for a way to remove offshore platforms that is ecologically sound and more efficient than currently available systems.

SUMMARY OF THE INVENTION

It is therefore an object of this invention to provide an improved system for cutting metal casings.

It is another object of this invention to provide an apparatus and method for efficiently severing an offshore platform from the sea bed.

It is another object of this invention to provide a system that will minimize the time required to cut a pile or conductor of an offshore platform.

These and other objects of the invention, as will be apparent herein are accomplished by providing an apparatus and method for cutting a metal casing with an ultrahigh-pressure abrasive fluid jet. In accordance with a preferred embodiment of the present invention illustrated herein, a cutting assembly having a nozzle mounted in one end is lowered inside the casing to be cut to a desired depth. The apparatus is then anchored to an inner surface of the casing. Although this may be accomplished in a variety of ways, in a preferred embodiment illustrated herein, the apparatus is provided with a pneumatic packer which, when inflated, engages the inner surface of the casing. In an alternative embodiment, an hydraulic gripper is used.

In a preferred embodiment, an ultrahigh-pressure pump generates a stream of pressurized fluid that is conveyed by a feed line through a nozzle to generate an ultrahigh-pressure fluid jet, which passes through a mixing chamber provided in the apparatus. A second feed line conveys a volume of abrasives to the mixing chamber such that the ultrahigh-pressure fluid jet and abrasives combine to form an abrasive fluid jet. In one embodiment, the volume of abrasive is entrained in the fluid stream due to a vacuum region created by the pressurized stream passing through the nozzle. In an alternative embodiment, the abrasives are entrained in a pressurized stream of a low-density medium such that the pressurized abrasive stream is injected into the ultrahigh-pressure fluid jet in the mixing chamber.

In a preferred embodiment, the packer is coupled via an adapter to a cylinder which in turn is coupled to a nozzle block. Contained within the cylinder is a drive system which allows the abrasive fluid jet to rotate in a substantially horizontal plane at a steady, slow rate, and to move up and down in a vertical plane. Encoders are preferably also provided within the cylinder to track the rotary and linear positions of the abrasive fluid jet.

After the apparatus has been lowered and secured in place, an abrasive fluid jet is generated as discussed above. The abrasive fluid jet is positioned relative to the inside surface of the casing. In a preferred embodiment, this is accomplished via standoff adjustment wheels. Once the abrasive fluid jet has blown through all casings to be cut, the jet is rotated 360° in a substantially horizontal plane, thereby severing the casing. To ensure that a complete cut is made, the abrasive fluid jet may be rotated more than 360° and then moved up and down in a vertical plane to complete the cut, if, for example, the cut is in the form of a spiral. Different sensors such as hydrophones or optical sensors may be used to track the position and progress of the jet.

In the preferred embodiment illustrated herein, the desired cuts are performed in a water environment. In an alternative embodiment, the apparatus is provided with an air outlet that extends to a point above the nozzle and a water inlet that extends below the nozzle. By forcing pressurized air into the region between the air outlet and water inlet, a volume of water is displaced and forced up through the water inlet to a region above the packer, thereby creating an air environment in the vicinity of the abrasive fluid jet.

DETAILED DESCRIPTION OF THE INVENTION

Figure 1:
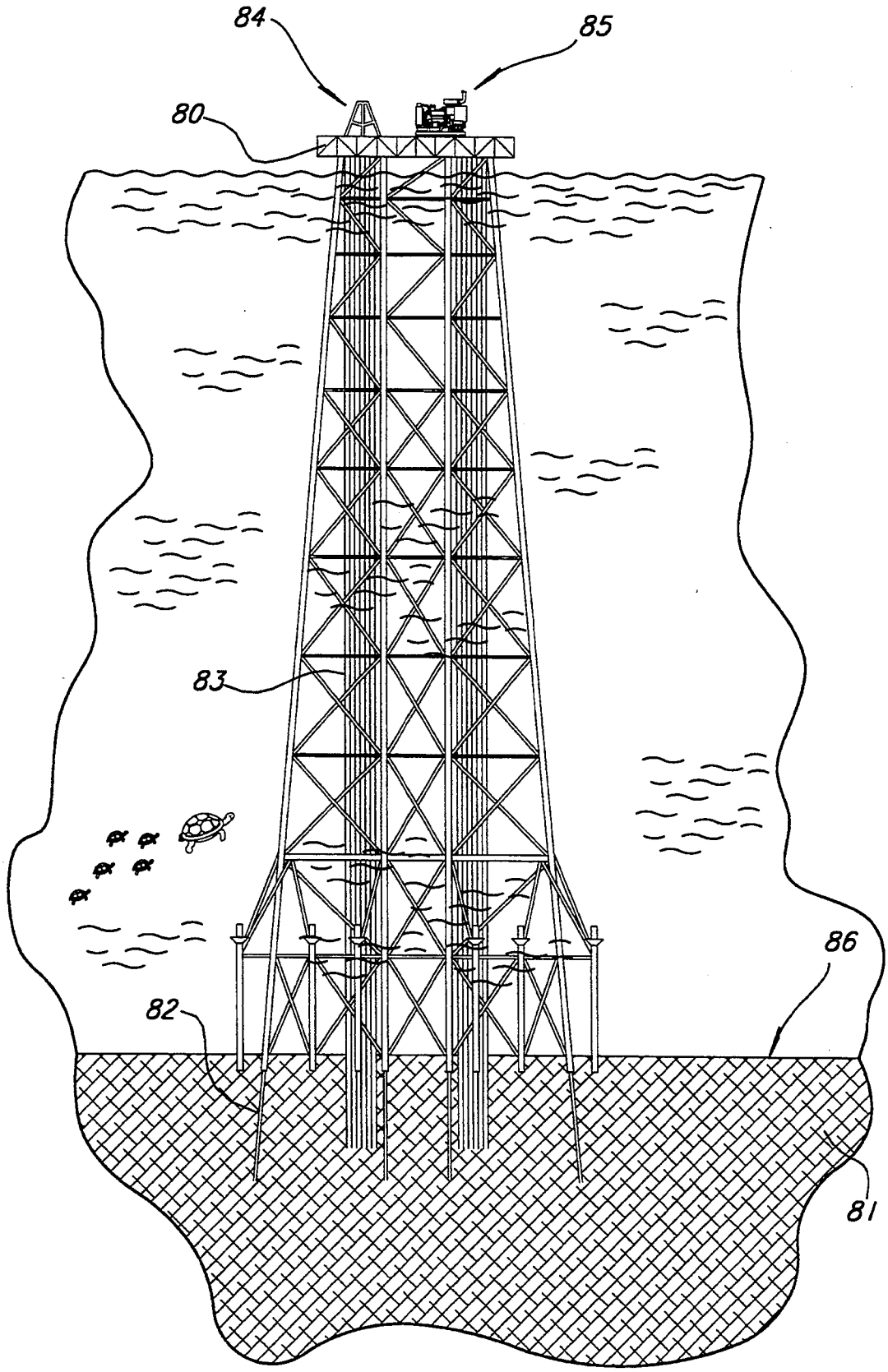
FIG. 1 is an elevational view of an offshore platform that may be removed in accordance with the present invention.

As illustrated in FIG. 1, offshore platforms 80 are anchored to the ocean floor by piles 82 consisting of hollow casings 12 or pipes driven into the sea bed 81, and draw oil up through conductors 83 consisting of several hollow casings 12 of different diameters stacked within each other and sealed together with concrete grout. A typical conductor may consist of four casings, the first three having a thickness of 0.5 to 0.625 inches and outer diameters of 24 inches, 16 inches and 13 inches, and the fourth casing having a thickness of 0.5 or 0.625 inches and an outer diameter of 7 inches or 9.625 inches. A typical pile may be 1.5 inches thick and have an outer diameter of 48 inches. To remove an offshore platform, the casings of the piles and conductors must be severed below the sea bed, typically twenty feet below the mudline 86. Superior results are achieved by cutting these casings in accordance with the present invention.

Figure 2:
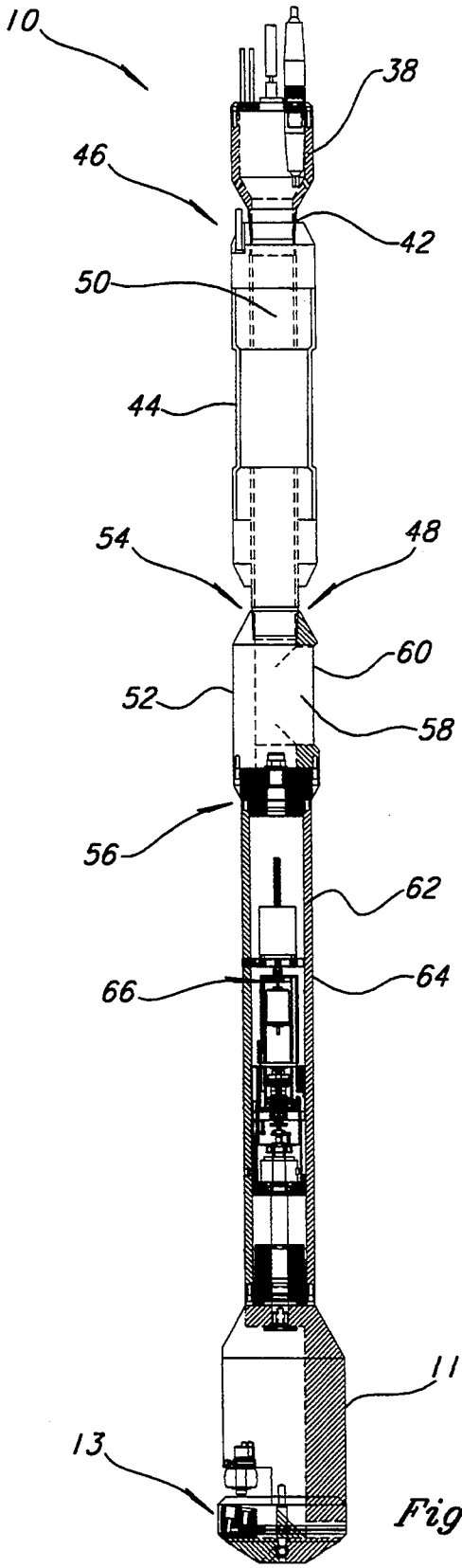
FIG. 2 is a cross-sectional elevational view of a preferred embodiment of the present invention.
Figure 3:
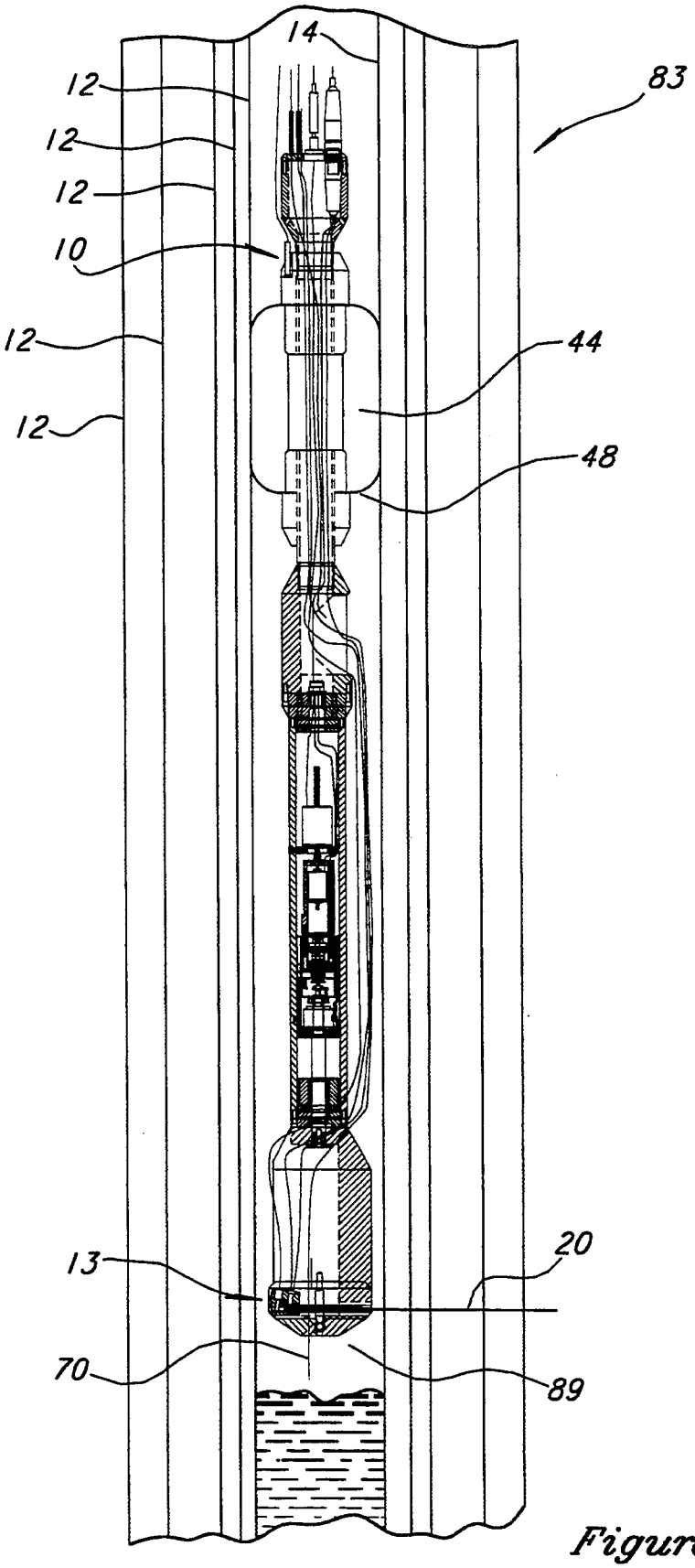
FIG. 3 is a cross-sectional elevational view of a preferred embodiment of the present invention, illustrating the operation of one of the elements and the creation of an air environment.

As illustrated in FIGS. 2 and 3, an apparatus 10 for cutting a metal casing 12 below the sea bed is provided with a first adapter 38 sealingly engaged at the location identified by reference numeral 42 to a first end 46 of a pneumatic packer 44. Any commercially available packer may be used, for example, Tigre Tierra Packers manufactured by Aardvark Corporation. A second adapter 52 is coupled at a first end 54 to a second end 48 of the pneumatic packer 44, and is coupled at a second end 56 to a cylinder 62. The cylinder 62 is in turn coupled to nozzle block 11 which houses the jet manifold 13.

Figure 8:
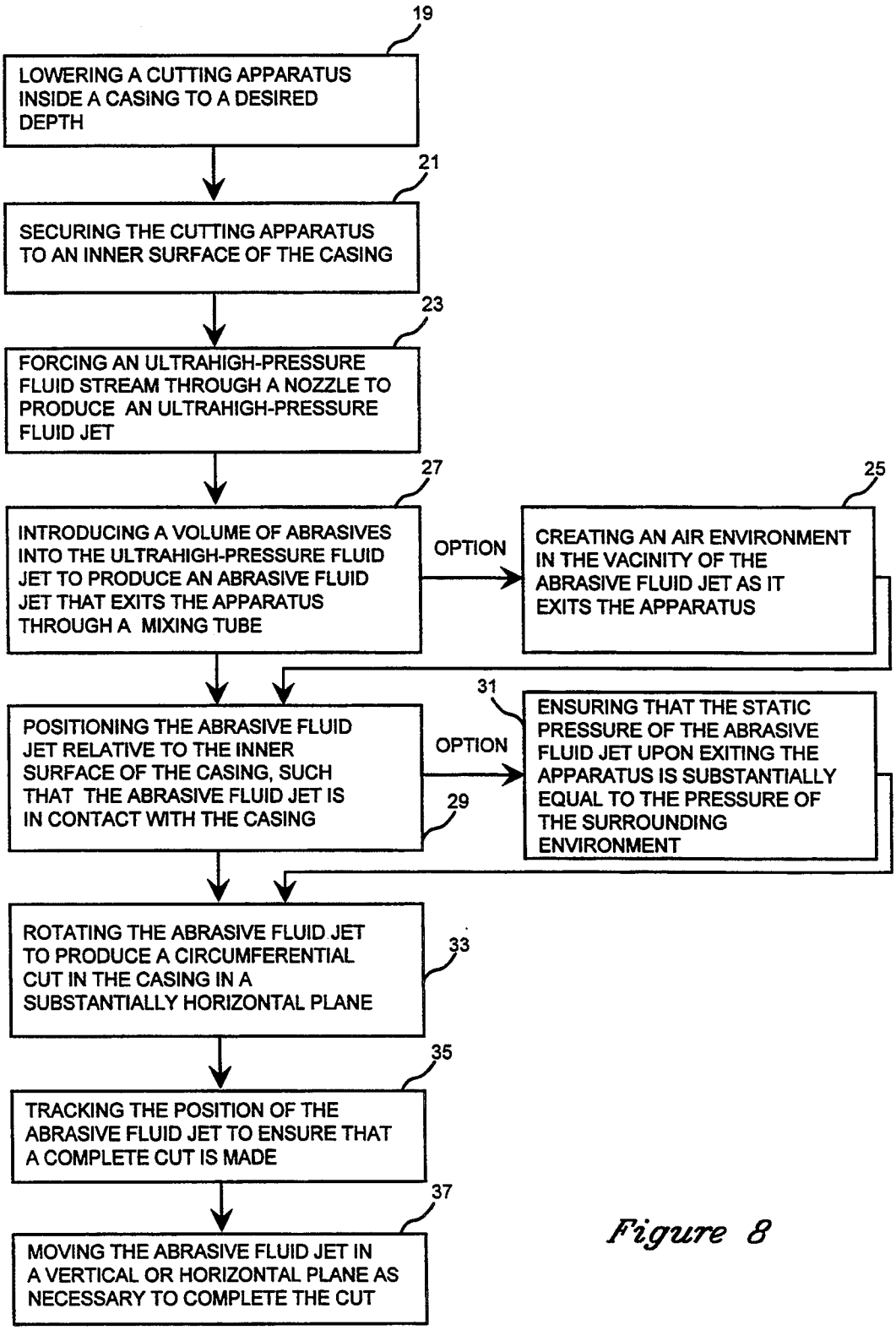
FIG. 8 is a diagram illustrating the steps of a preferred embodiment of the present invention illustrated herein.

In operation, as illustrated in FIGS. 3 and 8, the apparatus is lowered inside a casing to be cut to a desired depth, step 19, for example by a tripod and pulley system 84 set up over the entrance to the casing. The apparatus 10 is secured to an inner surface 14 of the casing 12, step 21. Although this may be accomplished in a variety of ways, in a preferred embodiment, as illustrated in FIGS. 2 and 3, the pneumatic packer 44 is inflated, whereby it engages the inner surface 14 of the casing 12. The pneumatic packer 44 is inflated via air line 72 as illustrated in FIG. 5.

Figure 4:
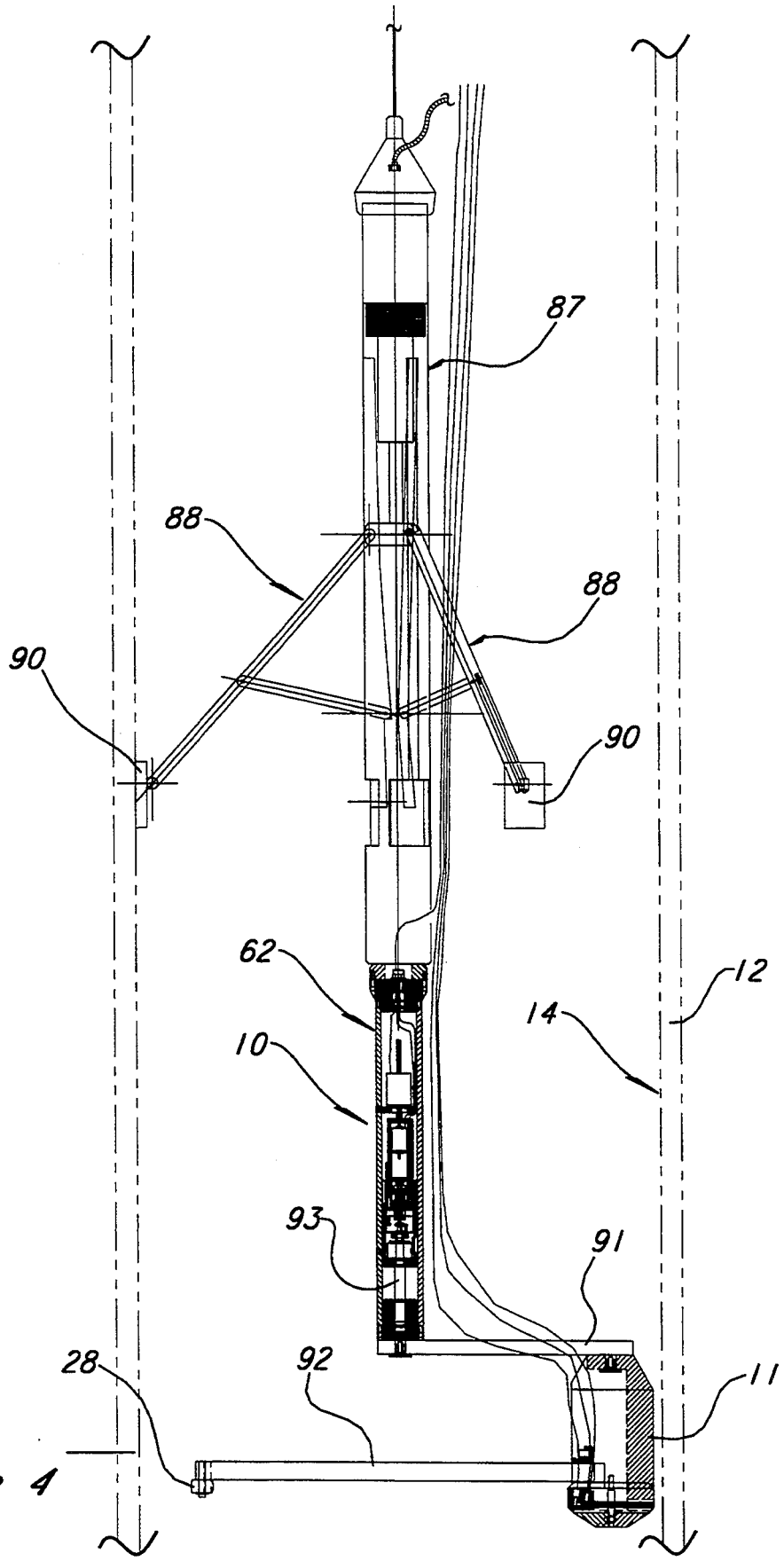
FIG. 4 is a cross-sectional elevational view of an alternative embodiment of the present invention.

In an alternative embodiment, as illustrated in FIG. 4, gripper 87 is used to anchor the apparatus 10 to the inner surface 14 of the casing 12. The gripper 87 is electrically actuated such that arms 88 having friction pads 90 extend outward to engage the inner surface 14. The gripper 87 is coupled directly to the cylinder 62. Nozzle block 11 is coupled to the drive shaft 93 in the cylinder 62 via extension bracket 91 and to stand-off adjustment wheels 28 via extension bracket 92. Such a configuration may be used, for example, inside a casing having a relatively large inner diameter.

Figure 7:
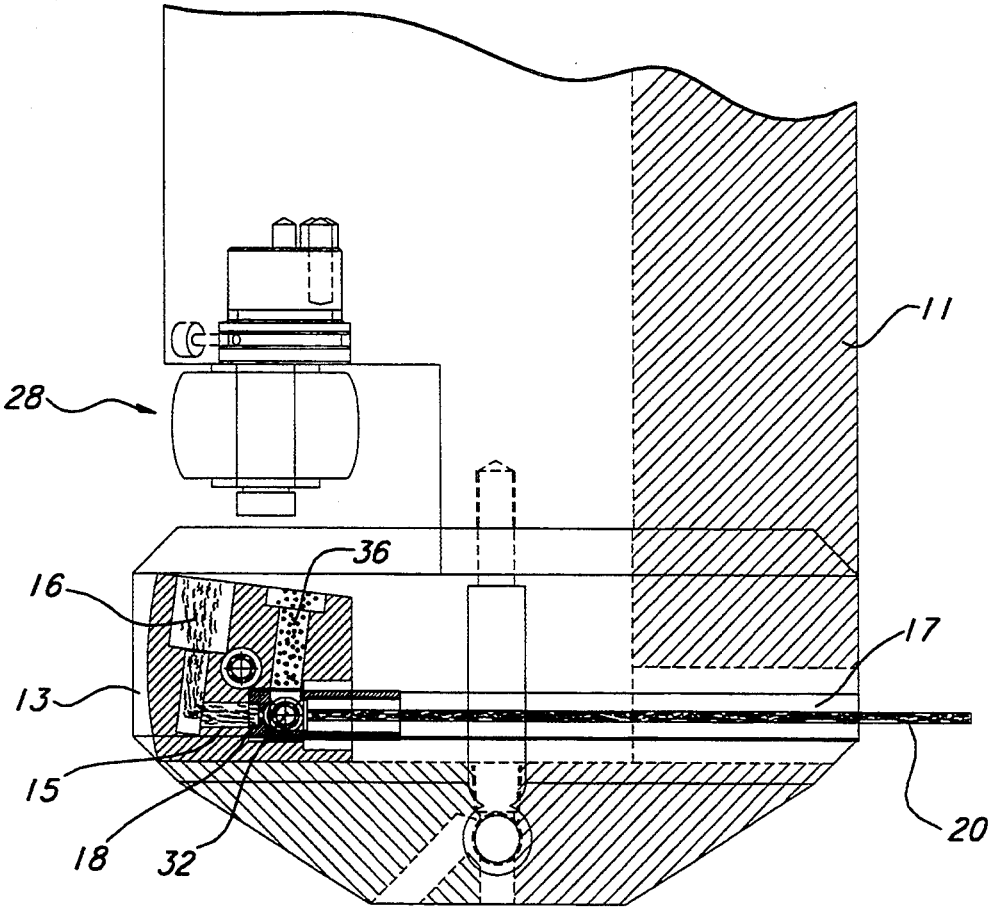
FIG. 7 is a detail of FIG. 6 illustrating a jet manifold of a preferred embodiment of the present invention.

The casing is cut in accordance with the present invention using an ultrahigh-pressure abrasive fluid jet. To generate the abrasive fluid jet, an ultrahigh-pressure pump 85 generates an ultrahigh-pressure fluid stream 16 that may range from 20,000–100,000 psi, depending on the number and thickness of casings. The ultrahigh-pressure fluid stream 16 is conveyed by a first feed line 30 to the jet manifold 13. In a preferred embodiment, the ultrahigh-pressure stream 16 is delivered to the jet manifold 13 by a hose assembly manufactured by How Systems International of Kent, Wash., Part No. 003430-106, that is flexible enough to take up one slow rotation of the manifold. An ultrahigh-pressure swivel 78 mounted in the first adapter 38 to the feed line 30 takes up the torsional component of the twist. As illustrated in FIG. 7, the ultrahigh-pressure fluid stream passes through settling chamber 15 and nozzle 18, thereby generating an ultrahigh-pressure fluid jet (not shown), step 23. The ultrahigh-pressure fluid jet then enters mixing chamber 32.

As further illustrated in FIGS. 5 and 7, a volume of abrasives 36 is conveyed by a second feed line 34 to the jet manifold 13 such that abrasives enter mixing chamber 32 to be entrained in the ultrahigh-pressure fluid jet, thereby generating an abrasive fluid jet 20, step 27. Although a variety of abrasives may be used, for example copper slag or chilled iron, in a preferred embodiment, garnet 36 mesh is used and is delivered at a constant flow rate of 7 pounds per minute to avoid variations in cutting power. The abrasive fluid jet 20 exits the nozzle block 11 of the apparatus 10 through mixing tube 17. In a preferred embodiment of the present invention illustrated herein, the mixing tube 17 is made of a carbide or boride compound and is 6 inches long for a casing having an innermost diameter of 9.625 inches. For casings having smaller inner diameters, for example 7 inches, a 4 inch long mixing tube 17 is used. The nozzle 18, mixing chamber 32 and mixing tube 17 are coupled together in a cartridge assembly, as described in U.S. Pat. No. 5,144,766, to Hashish et al.

Figure 5A:
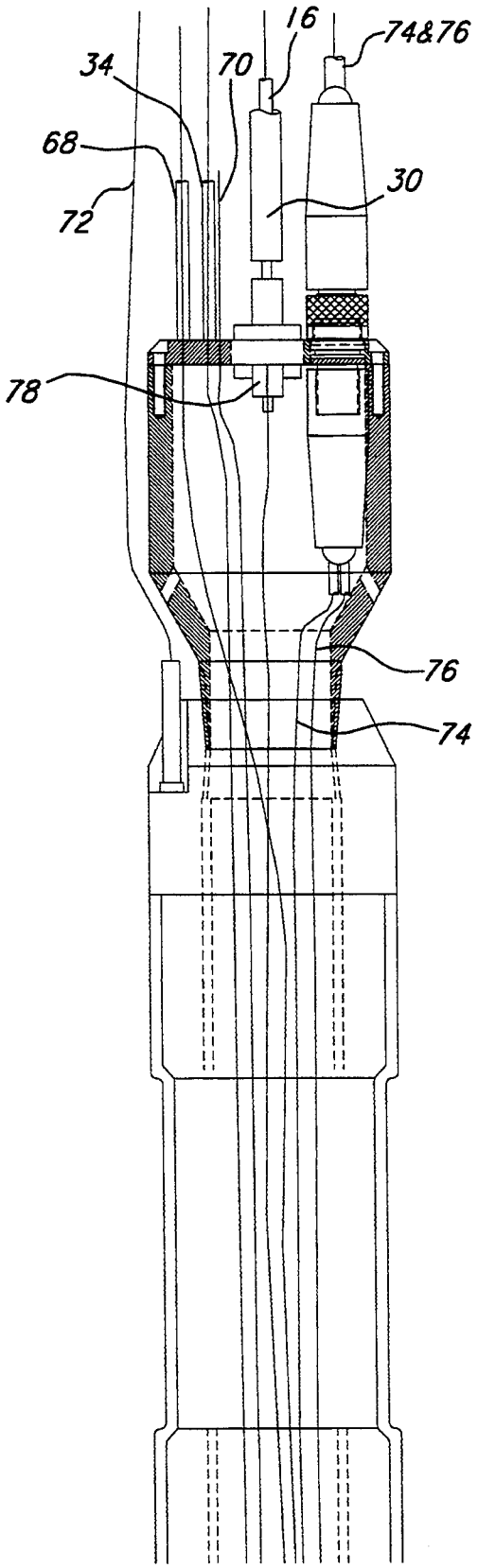
FIGS. 5*a–c* are cross-sectional elevational views of a preferred embodiment of the present invention illustrating the paths of various conduits.
Figure 5B:
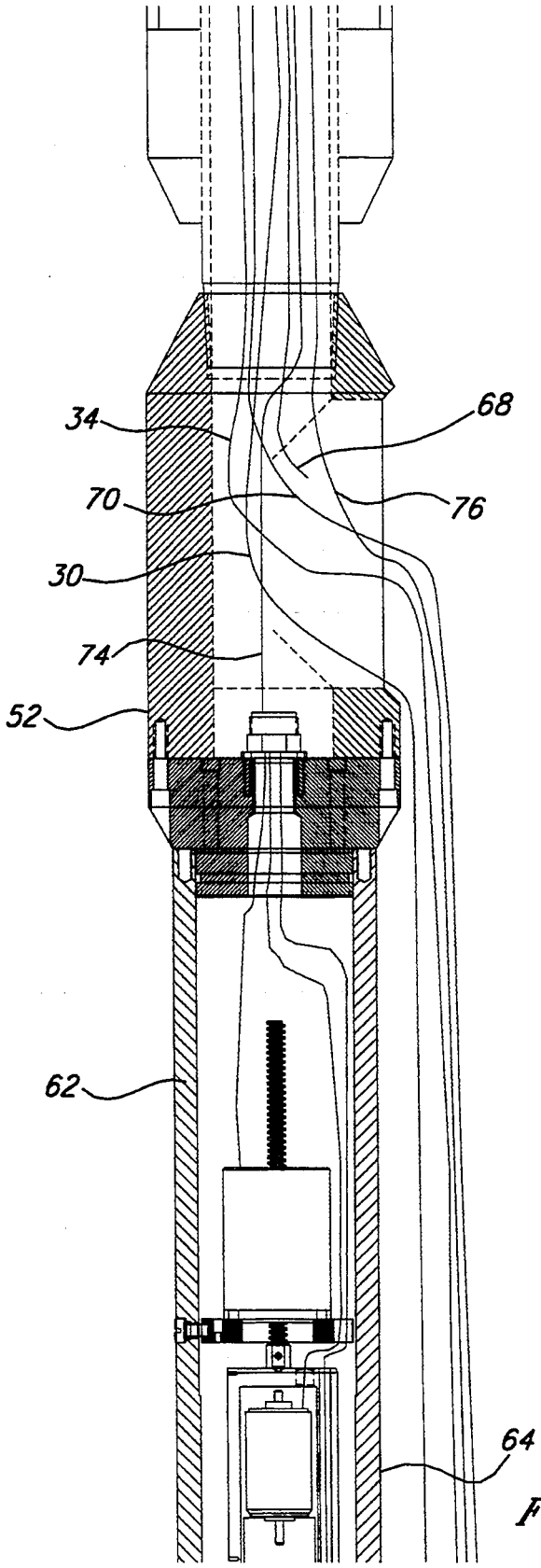
Figure 5C:
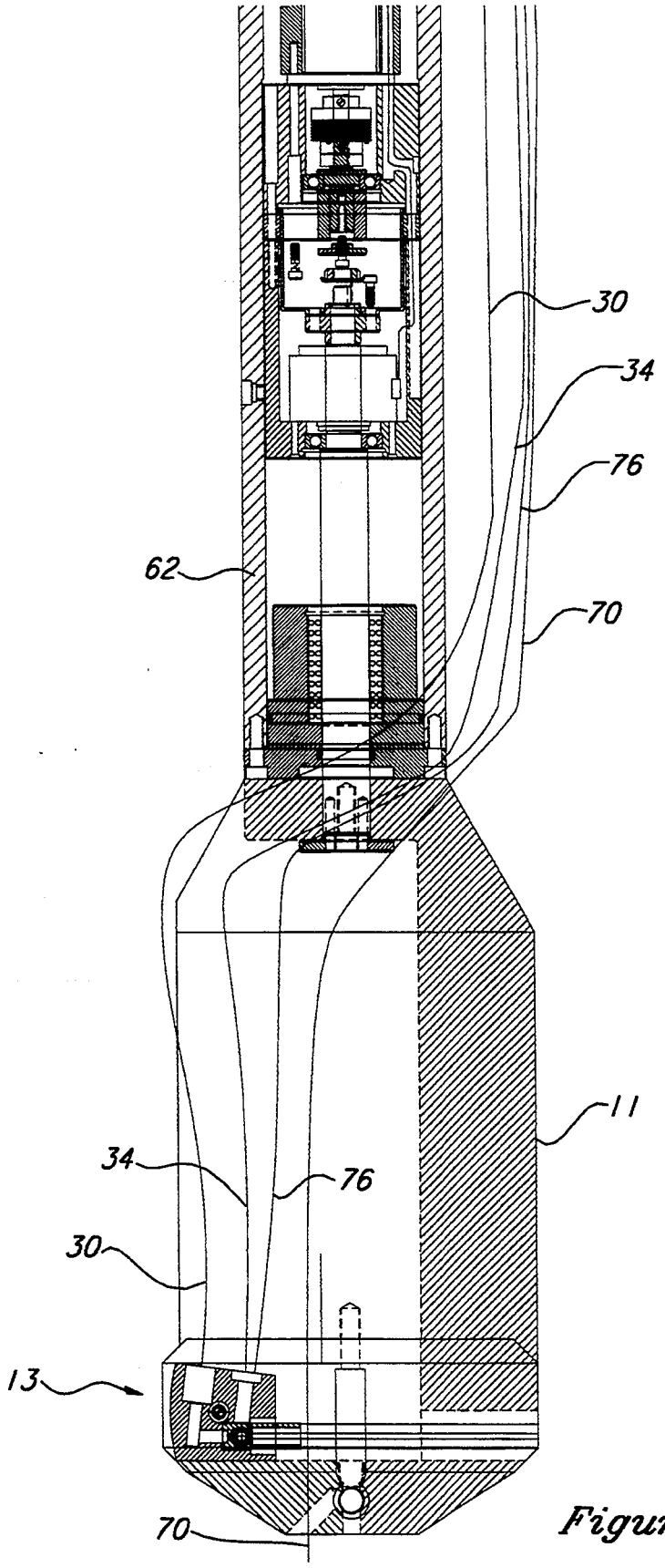

In a preferred embodiment of the present invention illustrated herein, the abrasives 36 are entrained in the ultrahigh-pressure fluid jet due to a vacuum created by the jet passing through the nozzle 18. In an alternative embodiment, the abrasives are entrained in a pressurized stream of a low density medium, for example air, nitrogen or carbon dioxide, to compensate for pressure losses in the system such that the abrasives are injected into the ultrahigh-pressure fluid jet. As a result, the static pressure of the abrasive fluid jet as it exits the apparatus is substantially equal to the pressure of the surrounding environment, step 31. By equalizing the pressure of the abrasive fluid jet with the surrounding environment, the abrasive fluid jet is inhibited from entraining the surrounding environment. As a result, the abrasive fluid jet remains more focused. The quality of the abrasive fluid jet may be monitored by measuring either the vacuum or pressure in the mixing chamber via the vacuum/pressure transducer line 76, as illustrated in FIGS. 5*a–c*. In a preferred embodiment, tubing having sufficient compressive strength is used for the second feed line 34 such that it will not crush at water depths of 300 feet. Any commercially available system for providing a pressurized hopper to contain the abrasives and a pressurized feed line may be used, for example those manufactured by Pauli and Griffin.

As illustrated in FIG. 5, the first adapter 38 is adapted to allow the various feed lines to pass through it and into a hollow central region 50 of the packer 44. The various lines pass through the packer into an inner region 58 of the second adapter 52, where they exit the second adapter 52 through opening 60 and extend along the outer surface 64 of cylinder 62.

The pile and conductor casings are typically full of water. As a result, the cutting of the casings in accordance with a preferred embodiment of the present invention occurs within a water environment. In an alternative embodiment of the present invention, as illustrated in FIGS. 5, 3 and 8, an air environment 89 is created in the vicinity of the abrasive fluid jet 20 as it exits the apparatus, step 25. This is accomplished by forcing pressurized air through air outlet tube 68 which extends into the apparatus to a point above jet manifold 13. The apparatus is further provided with a water inlet tube 70 which extends through the apparatus and runs along the outer surface 64 of the cylinder 62 to a point below the jet manifold 13. By forcing pressurized air through air outlet tube 68, a volume of water between the second end 48 of the packer 44 and the water inlet 70 is forced to flow upward through water inlet 70 to a point above the packer 44. By displacing the volume of water, an air environment 89 is created in the vicinity of the abrasive fluid jet 20 as it exits the apparatus 10. Water leaking past the packer 44 or through the cut being made in the casing will flow down by gravity to the bottom of the air environment to be forced by the incoming pressurized air to pass through the water inlet to the region above the packer 44. In a preferred embodiment, a water level sensor is used to monitor the air environment.

Figure 6:
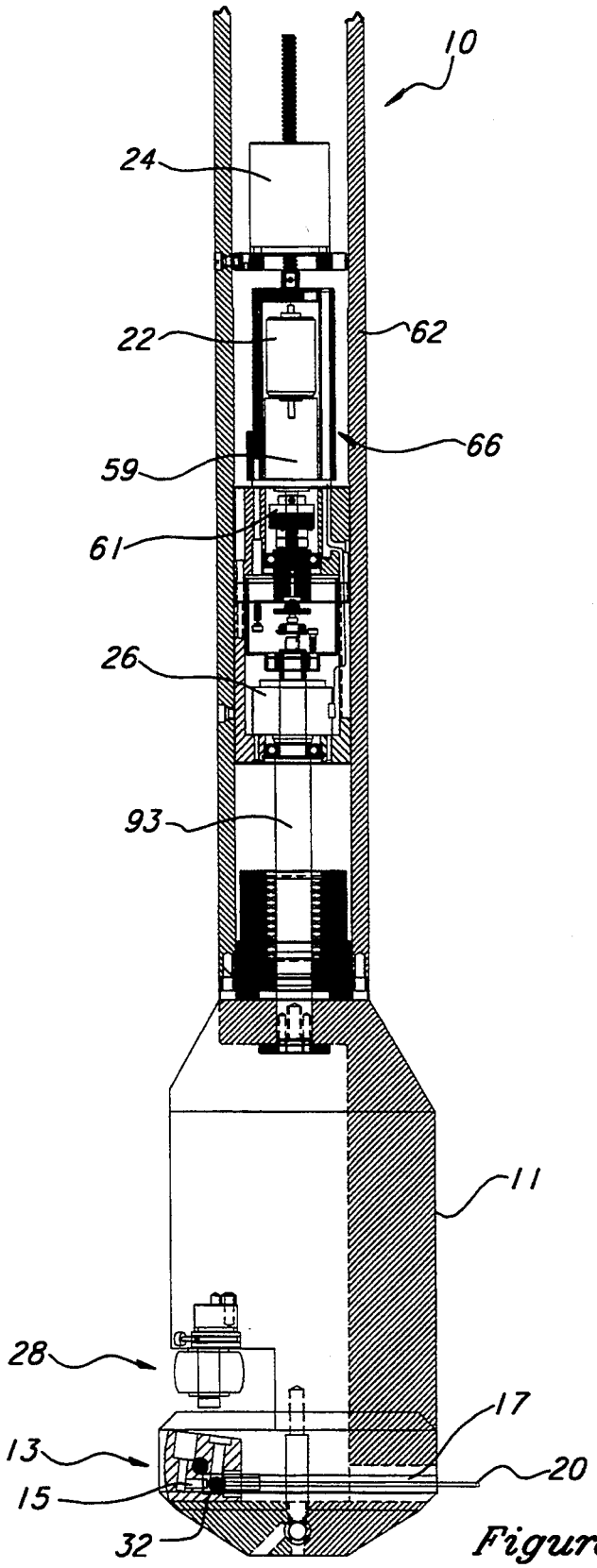
FIG. 6 is a detail of FIG. 2, illustrating a drive assembly and nozzle assembly of a preferred embodiment of the present invention.

The motion of the abrasive fluid jet is controlled by a drive assembly 66 located within cylinder 62, as illustrated in FIG. 6. The drive assembly 66 includes a linear actuator 24 which allows the entire assembly below the linear actuator 24 to move up and down in a vertical plane. It will therefore be appreciated by one of ordinary skill in the art that the apparatus illustrated in FIG. 6 is shown in its most upward position. The drive assembly 66 further includes a motor 22. In a preferred embodiment of the present invention illustrated herein, a very steady, slow rate of rotation for the abrasive fluid jet is achieved by using a 1,000 RPM DC motor or a hydraulic motor through a speed reducer 59 having a harmonic/planetary gear reduction system with a ratio of 54,880:1. It is believed that a steady, slow speed is beneficial because speed fluctuations can leave uncut islands in the casing which are very difficult to cut at a later point in time.

As further illustrated in FIG. 6, the torque for rotation is delivered through a slip clutch 61 to ensure that if the jet manifold 13 is obstructed as its rotates, the drive system will not be overloaded. In a preferred embodiment, the driver assembly 66 is sealed within the cylinder 62 made of anodized aluminum with a seal between the shaft and end bushing, and static seals between the bushings and the cylinder are capable of resisting external pressures found at a depth of 500 feet in water. As illustrated in FIG. 5, the electrical connections are made through standard underwater electrical connectors as illustrated at 74. Also enclosed within cylinder 62 in a preferred embodiment illustrated herein, is an optical encoder 26 which can track the position of the abrasive fluid jet; step 35.

As further illustrated in FIG. 7, the abrasive fluid jet is positioned relative to the inner surface of the casing to be cut via stand-off adjustment wheels 28, step 29. By moving the stand-off adjustment wheels 28 in a horizontal plane towards an inner surface of the casing opposite the outlet for the abrasive fluid jet, the nozzle block 11 is pushed away from the inner surface contacted by the stand-off wheels 28, thereby decreasing the stand-off distance, namely the distance between the abrasive fluid jet and the inner surface being cut. In a preferred embodiment, a stand-off of 1/16 to ⅓ inch is maintained.

The abrasive fluid jet is then rotated in a substantially horizontal plane to produce a circumferential cut in the casing, step 33. To ensure that a complete cut is made, the abrasive fluid jet is rotated over 360° and then moved up and down in a vertical plane to link up ends of the cut in the eventuality it was made in the form of a helix, step 37.

Figure 9:
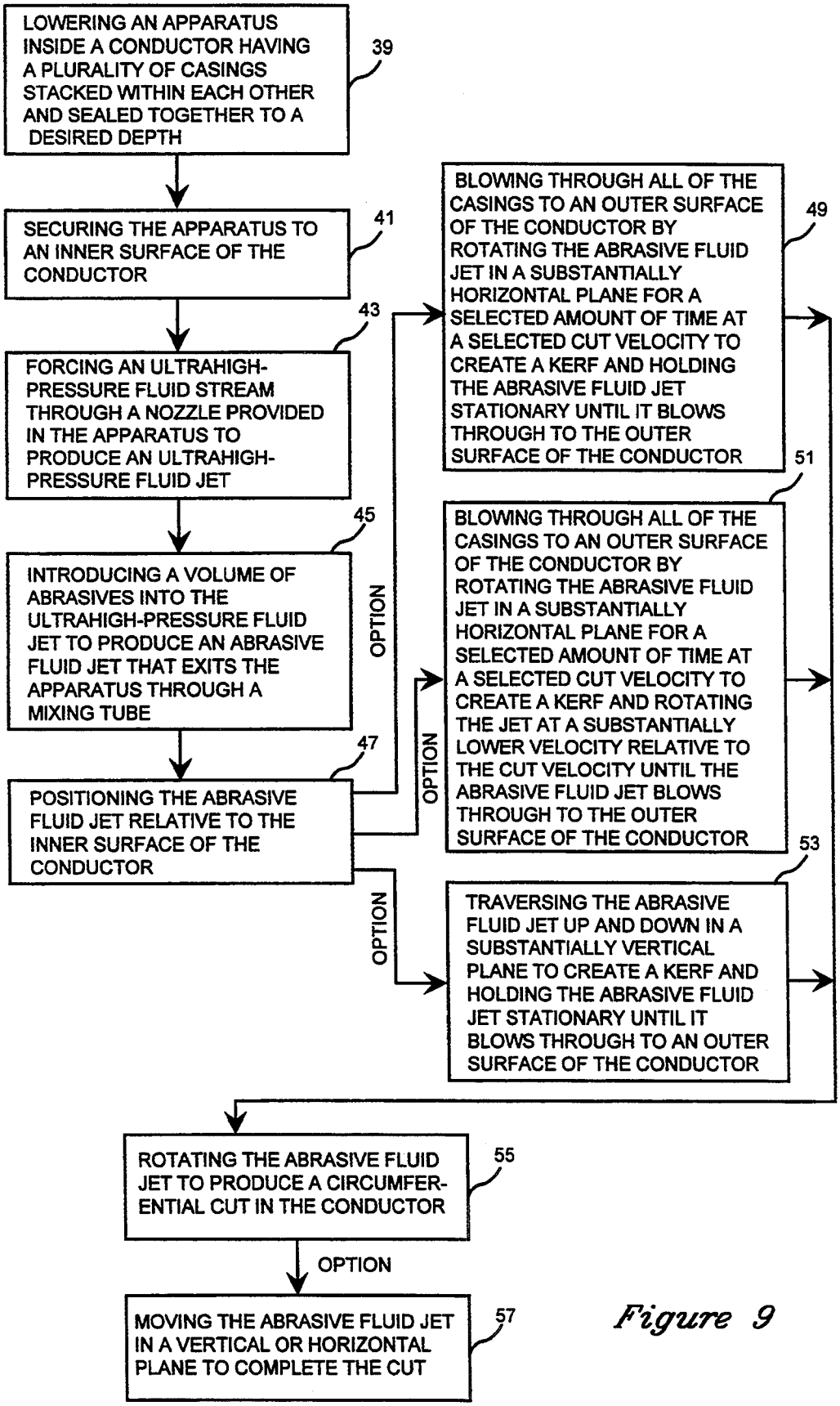
FIG. 9 is a diagram illustrating the steps of alternative embodiments of the present invention.

When cutting a conductor made of several casings stacked within each other and sealed with concrete gout, it is necessary to first blow through all the casings to an outer surface of the conductor before the circumferential cut may be made. Before the jet blows through the casings, however, it is forced to splash back on itself. This returning jet causes a substantial disturbance to the incoming jet and nearly destroys it. To overcome this problem, blow-through is achieved in accordance with a preferred embodiment of the present invention as illustrated in FIG. 9. The apparatus 10 is lowered, step 39, and secured to an inner surface of the conductor, step 41. The abrasive fluid jet is then generated, steps 43 and 45, and positioned relative to the inner surface of the conductor, step 47. The abrasive fluid jet is rotated in a substantially horizontal plane for a selected amount of time at a cut velocity to create a kerf for the jet to splashback into, thereby minimizing the negative impact of the splashback on the jet. The abrasive fluid jet is then held stationary until it blows through to an outer surface of the conductor, step 49, after which the abrasive fluid jet is rotated to produce a circumferential cut as discussed above, step 55. In an alternative embodiment, after the abrasive fluid jet has been rotated at a cut velocity to create a kerf, it is rotated in a substantially horizontal plane at a substantially reduced velocity relative to the cut velocity until the abrasive fluid jet blows through the final casing, step 51. In another alternative embodiment, the abrasive fluid jet is traversed up and down in a substantially vertical plane to create a kerf, after which the jet is held stationary until it blows through the conductor, step 53.

In a preferred embodiment illustrated herein, hydrophones (not shown) are located outside the casing to be cut, thereby allowing an operator to monitor the progress of the abrasive fluid jet as it blows through and cuts the casings. An example of a conventional system that may be used is a hydrophone Model No. 8101 made by Bruel and Kjaer with standard accessories such as power supply, measuring amplifier, sound level meter, and underwater cables.

When the ultrahigh-pressure abrasive fluid jet is cutting the casings of the piles or conductors, it generates noise over a considerable range of frequencies, all the way up to nearly 100 kHz. In monitoring the progress of the cut, a range of frequencies is selected to be listened to in which no other item is generating sound, in order to avoid confusion. If, for example, the jet is not cutting through all of the casings of a conductor, the sound intensity level is low and therefore sounds muffled. If, however, the jet is cutting through all of the casings, the sound intensity level rises sharply. It is therefore possible to monitor the cut as it is being made. If it becomes apparent that the jet is not cutting a section of the casing, the operator may reverse the motor, reduce the speed of rotation and recut any uncut area.

The monitoring of the cut with hydrophones may also be used to optimize the performance of the system. Typically, the casings of a conductor are eccentric, such that the thickness to be cut may vary circumferentially. The operator may therefore increase the speed of rotation of the jet as long as it is still able to cut through the entire thickness of the conductor. When the jet reaches a speed at which it is no longer cutting all the way through, the operator may reverse the motor, and reduce the speed to ensure a complete cut is made.

The cutting of a metal casing may therefore be accomplished in accordance with the present invention in either an underwater or air environment. Abrasives may be entrained in the ultrahigh-pressure fluid jet in accordance with the present invention by the action of a vacuum created by the passage of the ultrahigh-pressure fluid jet through a nozzle or by entraining the volume of abrasives in a pressurized stream of a low density medium. It has been found that while cutting in a water environment using a vacuum feed to entrain the abrasives produces acceptable results in some situations, for example when cutting piles or conductors made of relatively few casings, significantly superior results are achieved by creating an air environment in the vicinity of the nozzle in accordance with the present invention. It has also been found that while even better results are achieved by entraining the abrasives in a pressurized stream of a low density medium when cutting in an air environment, preferred results are achieved when the cutting is performed in a water environment in accordance with the present invention, using pressurized abrasives.

From the foregoing, it will be appreciated that, although embodiments of the invention have been described herein for purposes of illustration, various modifications may be made without deviating from the spirit of the invention. Thus, the present invention is not limited to the embodiments described herein, but rather is defined by the claims which follow.

We claim:

1. Apparatus for cutting a metal casing below the sea bed comprising:

means for lowering the apparatus having a maximum width that is less than an inner diameter of the casing inside the casing to a desired depth;

a first feed line for conveying an ultrahigh-pressure fluid stream through a nozzle to generate an ultrahigh-pressure fluid jet, the ultrahigh-pressure fluid jet passing into a mixing chamber provided in the apparatus;

a second feed line for conveying a volume of abrasives to the mixing chamber such that the ultrahigh-pressure fluid jet and the abrasives combine to form an abrasive fluid jet that exits the apparatus through a mixing tube;

a first adapter provided with means for allowing the first and second feed lines to pass through it, sealingly engaged to a first end of a pneumatic packer, the packer engaging an inner surface of the casing when inflated to secure the apparatus to the casing and having a hollow central region to allow the first and second feed lines to pass through it;

a second adapter coupled at a first end to a second end of the packer and coupled at a second end to a first end of a cylinder, the second adapter provided with means for allowing the first and second feed lines to pass from an inner region of the adapter to an outer surface of the cylinder such that the cables may extend along a length of the cylinder to be coupled to the nozzle that is mounted in a nozzle block coupled to a second end of the cylinder; and a drive assembly provided within the cylinder to rotate the abrasive fluid jet in a substantially horizontal plane and to move the abrasive fluid jet in a vertical plane whereby the abrasive fluid jet is positioned and moved relative to the inner surface of the casing to cut the casing in a substantially horizontal plane.

2. The apparatus according to claim 1, further comprising an hydrophone assembly to monitor the performance of the abrasive fluid jet.

3. The apparatus according to claim 1 wherein the volume of abrasives is entrained in a pressurized stream of a low density medium in the second feed line to compensate for pressure losses in the system such that the static pressure of the abrasive fluid jet as it exits the apparatus is substantially equal to the pressure of the surrounding environment.

4. The apparatus according to claim 1, further comprising:

means for introducing a volume of a low density medium into the abrasive fluid jet such that the static pressure of the abrasive fluid jet upon exiting the apparatus is substantially equal to the pressure of the surrounding environment.

5. The apparatus according to claim 1 further comprising:

an air outlet tube extending from a source of a pressurized low density medium to a point above the nozzle and a water inlet tube extending from a point above the packer to a point below the nozzle, whereby pressurized air is forced through the air outlet into the region below the packer such that a volume of water between the packer and the water inlet is forced to flow through the water inlet to a region above the packer, thereby displacing the volume of water to create an air environment in a vicinity of the abrasive fluid jet.

6. The apparatus according to claim 5 wherein the volume of abrasives is entrained in a pressurized stream of a low density medium in the second feed line to compensate for pressure losses in the system such that the static pressure of the abrasive fluid jet as it exits the apparatus is substantially equal to the pressure of the surrounding environment.

7. The apparatus according to claim 5, further comprising:

means for introducing a volume of a low density medium into the abrasive fluid jet such that the static pressure of the abrasive fluid jet upon exiting the apparatus is substantially equal to the pressure of the surrounding environment.

8. Apparatus for cutting a metal casing below the sea bed comprising:

means for lowering the apparatus having a maximum width that is less than an inner diameter of the casing inside the casing to a desired depth;

means for securing the apparatus to an inner surface of the casing;

means for providing an ultrahigh-pressure fluid stream to a nozzle provided in the apparatus to produce an ultrahigh-pressure fluid jet;

means for introducing a volume of abrasives into the ultrahigh-pressure fluid jet to produce an abrasive fluid jet;

means for positioning the abrasive fluid jet relative to the inner surface of the casing such that the abrasive fluid jet cuts the inner surface of the casing;

means for rotating the abrasive fluid jet to produce a circumferential cut in the casing in a substantially horizontal plane;

means for moving the abrasive fluid jet in a vertical plane, as the jet cuts the casing, to ensure that the cut is complete; and means for tracking the position of the abrasive fluid jet as the abrasive fluid jet rotates to produce the circumferential cut in the casing.

9. The apparatus according to claim 8, further comprising:

means for monitoring the performance of the abrasive fluid jet as the jet cuts the casing, so that an operator may move the jet as necessary to complete the cut.

10. The apparatus according to claim 8, further comprising:

means for creating an air environment in a vicinity of the abrasive fluid jet.

11. The apparatus according to claim 10, further comprising:

means for ensuring that the static pressure of the abrasive fluid jet upon exiting the apparatus is substantially equal to the pressure of the surrounding environment.

12. The apparatus according to claim 8, further comprising:

means for ensuring that the static pressure of the abrasive fluid jet upon exiting the apparatus is substantially equal to the pressure of the surrounding environment.

13. Apparatus for cutting a metal casing below the sea bed comprising:

means for lowering the apparatus having a maximum width that is less than an inner diameter of the casing inside the casing to a desired depth;

a first feed line for conveying an ultrahigh-pressure fluid stream through a nozzle to generate an ultrahigh-pressure fluid jet, the ultrahigh-pressure fluid jet passing into a mixing chamber provided in the apparatus;

a second feed line for conveying a volume of abrasives to the mixing chamber such that the ultrahigh-pressure fluid jet and the abrasives combine to form an abrasive fluid jet that exits the apparatus through a mixing tube;

a gripper having means to engage an inner surface of the casing to secure the apparatus to the casing, coupled at a first end to the means for lowering the apparatus and coupled at a second end to a first end of a cylinder, the gripper allowing the first and second feed lines to pass around it such that the cables may extend along a length of the cylinder to be coupled to the nozzle that is mounted in a nozzle block coupled to a second end of the cylinder; and a drive assembly provided within the cylinder to rotate the abrasive fluid jet in a substantially horizontal plane and to move the abrasive fluid jet in a vertical plane whereby the abrasive fluid jet is positioned and moved relative to the inner surface of the casing to cut the casing in a substantially horizontal plane.

14. A method for cutting a metal casing below the sea bed comprising:

lowering a cutting apparatus having a maximum width that is less than an inner diameter of the casing inside the casing to a desired depth;

securing the cutting apparatus to an inner surface of the casing;

forcing an ultrahigh-pressure fluid stream through a nozzle provided in the cutting apparatus to produce an ultrahigh-pressure fluid jet;

introducing a volume of abrasives into the ultrahigh-pressure fluid jet to produce an abrasive fluid jet that exits the apparatus through a mixing tube;

positioning the abrasive fluid jet relative to the inner surface of the casing such that the abrasive fluid jet is in contact with the casing;

rotating the abrasive fluid jet to produce a circumferential cut in the casing in a substantially horizontal plane;

tracking the position of the abrasive fluid jet as the abrasive fluid jet rotates to ensure that a complete cut is made; and moving the abrasive fluid jet in a vertical and horizontal plane while the abrasive fluid jet is cutting the casing, as necessary, to complete the cut.

15. The method according to claim 14, further comprising:

creating an air environment in the vicinity of the abrasive fluid jet.

16. The method according to claim 15, further comprising:

ensuring that the static pressure of the abrasive fluid jet upon exiting the apparatus is substantially equal to the pressure of the surrounding environment.

17. The method according to claim 14, further comprising:

ensuring that the static pressure of the abrasive fluid jet upon exiting the apparatus is substantially equal to the pressure of the surrounding environment.

18. A method for cutting a conductor below the sea bed, the conductor having a plurality of metal casings of varying diameters stacked within each other and sealed together with concrete grout, comprising:

lowering an apparatus having a maximum width that is less than an inner diameter of the conductor inside the conductor to a desired depth;

securing the apparatus to an inner surface of the conductor;

forcing an ultrahigh-pressure fluid stream through a nozzle provided in the apparatus to produce an ultrahigh-pressure fluid jet;

introducing a volume of abrasives into the ultrahigh-pressure fluid jet to produce an abrasive fluid jet that exits the apparatus through a mixing tube;

positioning the abrasive fluid jet relative to the inner surface of the conductor;

blowing through all of the casings to an outer surface of the conductor by rotating the abrasive fluid jet in a substantially horizontal plane for a selected amount of time at a selected cut velocity to create a kerf, and holding the abrasive fluid jet stationary until it blows through to the outer surface of the conductor;

rotating the abrasive fluid jet to produce a circumferential cut in the conductor in a substantially horizontal plane; and moving the abrasive fluid jet in a vertical or horizontal plane as necessary to complete the cut.

19. The method according to claim 18, further comprising:

listening to the abrasive fluid jet to ensure that a complete cut is made.

20. A method for cutting a conductor below the sea bed, the conductor having a plurality of metal casings of varying diameters stacked within each other and sealed together with concrete grout, comprising:

lowering an apparatus having a maximum width that is less than an inner diameter of the conductor inside the conductor to a desired depth;

securing the apparatus to an inner surface of the conductor;

providing an ultrahigh-pressure abrasive fluid stream to a nozzle provided in the apparatus to produce an abrasive fluid jet;

introducing a volume of abrasives into the ultrahigh-pressure fluid jet to produce an abrasive fluid jet that exits the apparatus through a mixing tube;

positioning the abrasive fluid jet relative to the inner surface of the conductor;

rotating the abrasive fluid jet in a substantially horizontal plane for a selected amount of time at a selected cut velocity to create a kerf;

rotating the jet in a substantially horizontal plane at a substantially lower velocity relative to the cut velocity until the abrasive fluid jet blows through to an outer surface of the conductor;

rotating the abrasive fluid jet to produce a circumferential cut in the conductor in a horizontal plane; and moving the abrasive fluid jet in a vertical or horizontal plane as need to complete the cut.

21. The method according to claim 20, further comprising:

listening to the abrasive fluid jet to ensure that a complete cut is made.

22. A method for cutting a conductor below the sea bed, the conductor having a plurality of metal casings of varying diameters stacked within each other and sealed together with concrete grout, comprising:

lowering an apparatus having a maximum width that is less than an inner diameter of the conductor inside the conductor to a desired depth;

securing the apparatus to an inner surface of the conductor;

providing an ultrahigh-pressure abrasive fluid stream to a nozzle provided in the apparatus to produce an abrasive fluid jet;

introducing a volume of abrasives into the ultrahigh-pressure fluid jet to produce an abrasive fluid jet that exits the apparatus through a mixing tube;

positioning the abrasive fluid jet relative to the inner surface of the conductor;

traversing the abrasive fluid jet up and down in a substantially vertical plane to create a kerf;

holding the abrasive fluid jet stationary until it blows through to an outer surface of the conductor; and rotating the abrasive fluid jet to produce a circumferential cut in the conductor in a substantially horizontal plane.

23. The method according to claim 22, further comprising:

listening to the abrasive fluid jet to ensure that a complete cut is made.

* * * * *